United States Patent [19]

Jett, Jr.

[11] Patent Number: 4,646,348

[45] Date of Patent: Feb. 24, 1987

[54] BLEND CONTROL FOR LOW VOLTAGE STEREO DECODERS

[75] Inventor: William B. Jett, Jr., San Jose, Calif.

[73] Assignee: National Semiconductor Corporation, Santa Clara, Calif.

[21] Appl. No.: 756,159

[22] Filed: Jul. 18, 1985

[51] Int. Cl.[4] ..... H04H 5/00

[52] U.S. Cl. ..... 381/10; 381/11; 330/254

[58] Field of Search ..... 329/163, 164, 167; 330/252, 254; 381/10, 11

[56] References Cited

U.S. PATENT DOCUMENTS

| | | | |
|---|---|---|---|
| 3,617,641 | 11/1971 | Fiet et al. | 381/10 |
| 3,707,603 | 12/1972 | Limberg | 381/11 |
| 3,952,161 | 4/1976 | Gilbert et al. | 381/10 |
| 4,037,056 | 7/1977 | Ienaka et al. | 381/10 |
| 4,074,075 | 2/1978 | Ohsawa | 381/10 |
| 4,198,543 | 4/1980 | Schertz et al. | 381/10 |
| 4,356,350 | 10/1982 | Ienaka | 381/10 |
| 4,390,746 | 6/1983 | Higashiyama et al. | 329/167 |
| 4,399,325 | 8/1983 | Tanaka et al. | 381/11 |
| 4,466,115 | 8/1984 | Hashimoto | 381/10 |

*Primary Examiner*—Forester W. Isen

*Attorney, Agent, or Firm*—Gail W. Woodward; Paul J. Winters

[57] ABSTRACT

A blend control circuit for attenuating the L-R signal in a stereo system as a function of a d-c control potential. The circuit is designed to operate with a very low supply voltage and to provide a nearly linear control of stereo separation as a function of control potential.

4 Claims, 3 Drawing Figures

BLEND CONTROL FOR LOW VOLTAGE STEREO DECODERS

BACKGROUND OF THE INVENTION

The signal to noise ratio of a weak FM stereo signal is much worse than that of an equally weak mono signal. It has been found that to achieve an acceptable signal to noise ratio the stereo signal must be about 20 db stronger than a mono signal. In the stereo receiver the L-R channel can be attenuated with respect to the L+R channel to achieve the noise advantages of mono performance. Of course, this is achieved with a loss of stereo separation. In a typical example, if the signal is above about 30 microvolts the L-R channel is operated at full level and the stereo reception is capable of greater than 50 db separation. At 3 microvolts input the L-R channel is attenuated 20 db to produce essentially mono operation. This is called blend. In the range between 3 and 30 microvolts, the L-R channel attenuation is inversely proportional to signal strength. This form of control has produced the most acceptable stereo system performance. In order to achieve a signal related blend the L-R channel attenuation must be responsive to a control voltage input. The LM1870 is a Stereo Demodulator with Blend and is available from National Semiconductor Corporation. The LINEAR DATABOOK © 1982 lists the IC characteristics and an operating supply voltage of 7–15 volts is specified. The safe DATABOOK lists the LM4500A which is a High Fidelity FM Stereo Demodulator with Blend and is also available from National Semiconuctor Corporation. Its supply range is listed at 8–16 volts. Both of these devices are useful in automobile and high performance portable radios. However, they do not operate at the low voltages normally desired in battery operated radios.

SUMMARY OF THE INVENTION

It is an object of the invention to provide a stereo blend circuit for operation at low supply voltages.

It is a further object of the invention to provide a variable signal attenuator responsive to a control voltage and powered from a low voltage supply.

These and other objects are achieved in a circuit configured as follows. A first pair of differentially operated transistors are cross coupled to a common load which is also driven from a second pair of differentially operated transistors. The two pairs are provided with a common tail current supply and are further cross coupled by a pair of tail current resistors which act to force common elements in the pairs to operate differentially If an L-R stereo signal is applied to the inputs of the two pairs the cross coupling results in substantial cancellation and therefore a highly attenuated output. If one pair is offset by a bias current developed in relation to a control voltage input, the cancellation is no longer complete and an L-R output develops. If the bias is adjusted to substantially eliminate conduction in one transistor pair, the maximum L-R output is developed. The stereo system is set up for maximum separation for this condition. Thus, for zero bias when the L-R signal vanishes, maximum blend occurs with zero separation. Intermediate bias values provide intermediate values of L-R signal and therefore separation.

DESCRIPTION OF THE INVENTION

Figure 1:
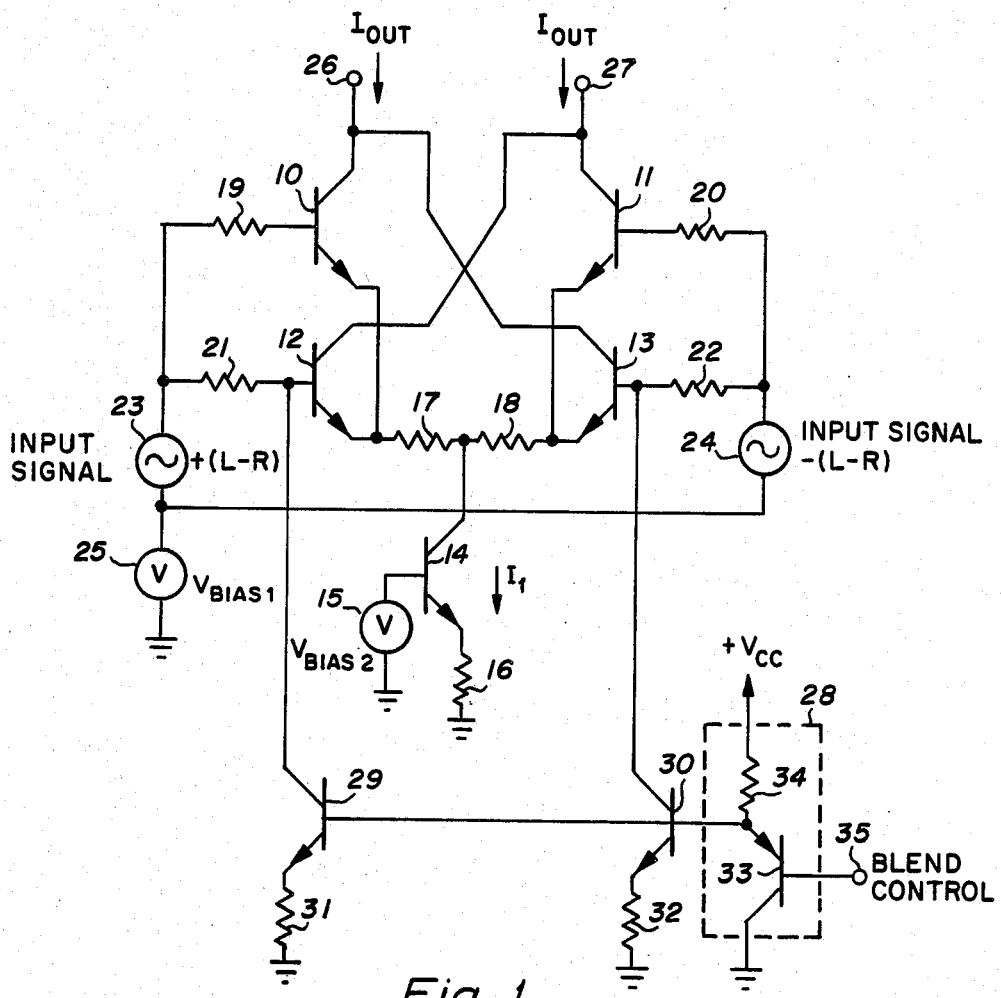
FIG. 1 is a schematic diagram of the circuit of the invention.

FIG. 1 is a simplified schematic diagram of the circuit of the invention. While not specifically shown, the circuit operates from a positive $V_{CC}$ supply rail that is returned to the positive terminal of a source of operating power, the negative terminal of which is grounded. Transistors 10–13 form a cross coupled adder. These transistors are connected differentially and are supplied with a common tail current $I_1$ by the action of transistor 14. The magnitude of $I_1$ is established by the value of $V_{BIAS2}$ which is a constant voltage supply 15, and the value of resistor 16. Thus, transistor 12 is operated differentially with transistor 13 and transistor 10 is operated differentially with transistor 11.

The collectors of transistors 10 and 13 are coupled together to output terminal 26 while the collectors of transistors 11 and 12 provide the output at terminal 27. While not shown, a conventional load means will return terminals 26 and 27 to $+V_{CC}$.

Resistors 17 and 18 degenerate the action of the differentially operated transistors and provide linearization of the transfer function. Resistor 17 is connected between the commonly connected emitters of transistors 10 and 12 and the collector of transistor 14 so that transistors 10 and 12 are differentially operated. Resistor 18 likewise causes transistors 11 and 13 to be operated differentially.

Resistors 19–22 isolate the bases of transistors 10–13 from the signal and bias sources. Transistors 10 and 12 are commonly driven from an L-R signal input source 23. Source 24 feeds the complement −(L-R) to transistors 11 and 13. Signal sources 23 and 24 are both returned to $V_{BIAS1}$ which is a constant voltage supply 25. If transistors 10–13 are matched, resistors 19–22 matched and resistor 17 matched to resistor 18. The cross coupling shown produces signal cancellation so that output terminals 26 and 27 will produce no signal. $I_{OUT}$ for this condition will be only direct current related to $I_1$. ($I_{OUT}=I_1/2$). This operating state will produce a stereo signal in which the only signal present is L+R. Thus, there is no stereo separation and the condition represents maximum blend of the left and right channels.

A blend control circuit is made up of control block 28 along with transistors 29 and 30 which have their collectors respective coupled to the bases of transistors 12 and 13. Resistors 31 and 32 degenerate the emitters of transistors 29 and 30. PNP transistor 33 has its collector grounded, its emitter returned to $+V_{CC}$ by way of resistor 34, and its base returned to blend control terminal 35. Thus, transistor 33 acts an emitter follower to control the bases of transistors 29 and 30. The value of resistor 34 is chosen to pass a maximum of about 25 microamperes, with its actual value being a function of $V_{CC}$. If the $V_{BE}$ of transistor 33 is approximately the same as that of transistors 29 and 30 it can be seen that the potentials across resistors 31 and 32 will be substantially equal to the potential at terminal 35. Thus, the currents in transistors 29 and 30 will be linearly proportional to the blend control terminal 35 potential.

When the potential at terminal 35 is zero, the current in transistors 29 and 30 will also be zero and the circuit will operate as described above to attenuate the L-R signal to essentially zero. This provides maximum stereo blend.

As the potential at terminal 35 rises current will flow in transistors 29 and 30. Transistor 29 current will develop an offset potential across resistor 21 which will reduce the current in transistor 12 and because of resistor 17 will produce a corresponding increase in current in transistor 10. Likewise, the current in transistor 30 will develop an offset in resistor 22 which will decrease conduction in transistor 13 and because of resistor 18 increase conduction in transistor 11. As the potential at terminal 35 rises the conduction in transistors 12 and 13 will decrease while the current in transistors 10 and 11 will increase. As this occurs the signal cancellation will diminish and the L-R component of $I_{OUT}$ will increase. At the point where conduction in transistors 12 and 13 goes substantially to zero the full L-R output signal will be available. For this condition maximum stereo separation will be present From the above it is clear that any degree of separation up to the maximum will be determined by the potential at terminal 35.

Figure 2:
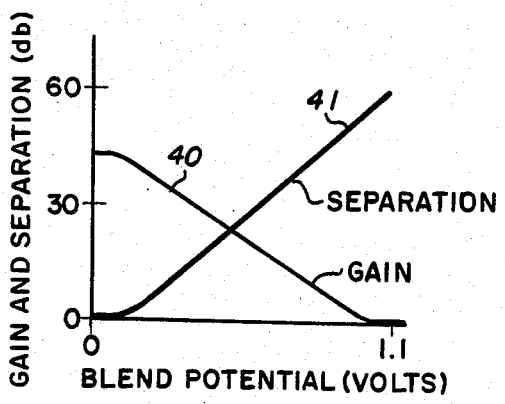
FIG. 2 is a graph showing the performance of the circuit of FIG. 1.

FIG. 2 is a graph showing the action of the circuit. Curve 40 shows the attenuation of the L-R channel as a function of the terminal 35 blend potential. At zero potential where the L-R output is lowest (maximum attenuation) the actual value is determined by component matching. A minimum value of 30 db is regarded as acceptable. At this control value the stereo separation shown by curve 41 is essentially zero thereby achieving maximum blend. As the potential at terminal 35 rises it can be seen that a relatively linear stereo separation (in db) increase is achieved. The maximum of 60 db is shown and its value is determined largely by the character of the stereo system in which the circuit is employed.

As described above, the current flowing in the control block 28 will be set by resistor 34 and is a function of the value of $V_{CC}$. The circuit of FIG. 3 can be substituted for block 28 and will make the control current independent of $V_{CC}$. PNP transistor 33 has its base returned to terminal 35 as in FIG. 1. However, constant current source 42 limits the control current to a set value (for example, about 25 microamperes). Diode 43 provides a current mirror action with respect to transistors 31 and 32. Resistor 44 degenerates diode 43. Resistors 45 and 46 form a voltage divider that ensures that diode 43 will not conduct when the emitter of transistor 33 is at its lowest potential. This will be the maximum blend condition and the emitter of transistor 33 will be one $V_{BE}$ above ground. Thus, the potential at terminal 35 can be duplicated by the potential across resistor 44. This in turn will determine the conduction in resistors 31 and 32. Since the performance of the FIG. 3 circuit is independent of $V_{CC}$ it is preferred.

It can be seen that the circuit provides a voltage controlled attenuation of the stereo L-R channel. The circuit of FIG. 1 is well suited to low supply voltage generation. For example, this circuit will operate at any supply voltage over about $V_{BE}+V_{SAT}$ or about 0.9 volt at 300° K.

EXAMPLE

Figure 3:
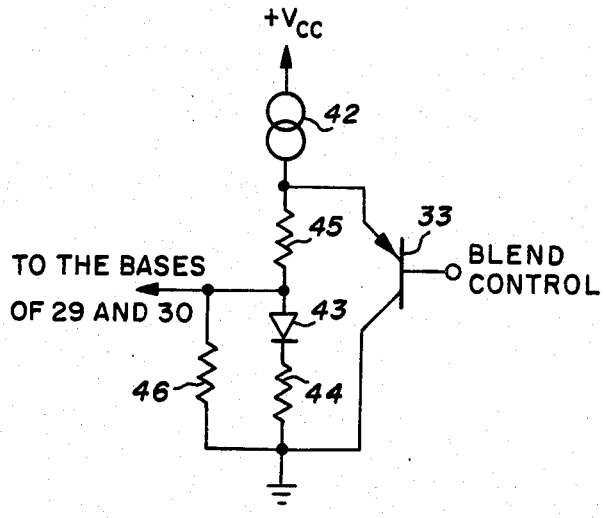
FIG. 3 is a schematic diagram of an alternative control circuit for use in the FIG. 1 circuit.

The circuit of FIG. 1 was constructed using the control circuit of FIG. 3 in breadboard form using standard monolithic junction isolated IC parts. The NPN transistors were high Beta vertical double diffused devices and the PNP transistors were high Beta substrate collector devices. The following component values were employed.

| PART | VALUE | UNITS |
|---|---|---|
| Resistor 16 | 1.1k | ohms |
| Resistors 17 and 18 | 6.8k | ohms |
| Resistors 19–22 | 10K | ohms |
| Resistors 31 and 32 | 2.4k | ohms |
| Source 42 | 25 | microamperes |
| Resistor 44 | 4.8k | ohms |
| Resistor 45 | 50k | ohms |
| Resistor 46 | 75k | ohms |

The circuit was designed to operate at a supply range of 1 to 10 volts. At the 2 volt supply level the circuit could handle an L-R signal level of 200 mv without appreciable distortion. Using a one volt control range the L-R output signal could be varied over more than 40 db.

The invention has been described and an operating example detailed. When a person skilled in the art reads the foregoing description, alternatives and equivalents, within the spirit and intent of the invention, will be apparent. Accordingly, it is intended that the scope of the invention be limited only by the claims that follow.

I claim:

1. A stereo blend control circuit for producing an output level related to a d-c control, said circuit comprising:

first and second transistors forming a first differential pair, said first pair having input and output terminals;

third and fourth transistors forming a second differential pair, said second pair having input and output terminals;

means for providing a constant tail current commonly to said first and second pairs;

means for cross coupling the output terminals of said first and second pairs whereby the combined output currents equal said tail current and differential signal inputs to said pairs cancel;

means for providing a common direct current bias voltage to the input terminals of both of said pairs;

resistive means coupled in series with the input terminals of said first pair;

control current biasing means coupled to said input terminals of said first pair whereby a current is passed through said resistive means to develop an offset bias that is a function of said control current; and means for varying said control current whereby said pairs produce cancelling outputs for zero control current and maximum output for maximum control current.

2. The circuit of claim 1 further comprising additional resistive means coupled in series with the input terminals of said second pair to match said resistive means in said first pair.

3. The circuit of claim 1 further comprising tail current resistors coupled in series between said constant tail current means and said first and second pairs whereby said first and second pairs are operated differentially with respect to each other.

4. The circuit of claim 1 wherein said control current biasing means comprise a pair of transistors each having a collector coupled one input of said first pair, an emitter coupled to ground and a base returned to a source of control potential.

* * * * *